US005215852A

United States Patent [19]

Kato et al.

[11] Patent Number: 5,215,852

[45] Date of Patent: Jun. 1, 1993

[54] IMAGE FORMING METHOD

[75] Inventors: Keishi Kato; Etsuo Shiozawa; Yoshio Kishimoto, all of Kanagawa, Japan

[73] Assignee: Fuji Photo Film Co., Ltd., Kanagawa, Japan

[21] Appl. No.: 733,774

[22] Filed: Jul. 22, 1991

[30] Foreign Application Priority Data

Jul. 24, 1990 [JP] Japan ..... 2-195693

[51] Int. Cl.[5] ..... G03G 13/16

[52] U.S. Cl. ..... 430/126

[58] Field of Search ..... 430/126, 67, 66

[56] References Cited

U.S. PATENT DOCUMENTS 4,810,605 3/1989 Yoshizawa et al. ..... 430/67
4,863,543 9/1989 Shiozawa et al. ..... 430/126
4,891,285 1/1990 Page ..... 430/126

*Primary Examiner*—John Goodrow
*Attorney, Agent, or Firm*—Sughrue, Mion, Zinn, Macpeak & Seas

[57] ABSTRACT

In the improved image forming method, an electrophotographic photoreceptor drum carrying an a-Si (amorphous silicon) photoconductor having a SiC (silicon carbide) is subjected to imagewise exposure to form a latent electrostatic image on the photoconductor, the latent image is then developed with a toner the particles of which are coated with a polymer having a cohesive energy constant G of at least 280, and the toner image formed on the photoconductor is adhesive-transferred onto an intermediate transfer element having an adhesive layer formed from an adhesive that is based on a urethane (meth)acrylic resin and which further contains at least one member selected from among an acrylic rubber, a saturated polyester resin and a fluorine-containing additive, with the toner image on the adhesive layer being retransferred onto a support to form a final image. To form a color image, this process including the retransfer step is repeated either three or four times depending on the number of colors to be reproduced. The toner image formed on the final support is such that is has been completely transferred form the photoconductor and hence has high contrast and quality in the absence of density unevenness and other defects.

13 Claims, 6 Drawing Sheets

IMAGE FORMING METHOD

BACKGROUND OF THE INVENTION

This invention relates to a method of forming a high-quality print image by electrophotography using an adhesive transfer process. More particularly, this invention relates to a method in which a toner image formed on the photoconductor on a photoreceptor drum is first adhesive-transferred onto an intermediate transfer element having an adhesive layer and then retransferred completely onto a final support. This method is suitable for use in medical diagnostic imaging (e.g. ultrasographic imaging, X-ray imaging and MRI), the production of printing monochromatic and color proofs, as well as in the formation of print image of high contrast and quality by recording means such as a laser printer.

An image recording method is known in which a latent electrostatic image is formed on a uniformly charged photoconductor by illumination with a light beam modulated with an image signal carrying continuous-tone image information and a toner image that is subsequently formed by a conventional electrophotographic process is transferred onto a support to produce a hard copy of the image of interest. In order to obtain a hard copy by electrophotography, the toner image on the photoconductor must be finally transferred onto a support such as a sheet of paper and to meet this need, various methods of transfer have been proposed.

The most common method for transferring the toner image on the photoconductor onto a support such as a sheet of paper is "electrostatic transfer" in which the toner image is transferred electrostatically, for example, using a corotron. However, using this transfer method to form a continuous-tone image has presented the following problems. 1. The efficiency of toner transfer depends on the density of toner image and the toner on the photoconductor cannot be completely transferred. The efficiency of transfer is particularly low in high-density and low-density areas, so if the electrostatic transfer method is adopted to produce a cotinuous-tone image of high contrast, both the highlights or the gradation in the high-density areas will be lost.

Since not all of the toner particles on the photoconductor can be transferred onto the support, the residual toner on the photoconductor must be removed by various methods including wiping with a blade. But this increases the chance of damaging the surface of the photoreceptor to prevent the production of a high-quality continuous-tone image since any surface damage is prone to cause artificial images such as streaks and uneven densities. 2. When the toner image is to be transferred onto the support such as a sheet of paper, the efficiency of toner transfer is much influenced by the electrical properties of the support at the microscopic level to cause unevenness in the density of the final image. Further, the electrical properties of the support can fluctuate under varying environmental conditions and this makes it difficult to obtain a consistent image. Particularly in the case where the toner image is transferred onto a receiving sheet that has absorbed moisture, the transfer efficiency usually drops to cause marked deterioration in image quality.

Thus, it has been difficult for the conventional electrostatic transfer method to permit the toner image on the photoconductor to be completely transferred onto the final support so as to produce a continuous-tone image of high quality and contrast.

Another transfer method known in the art involves the use of an intermediate transfer element.

An example of this method of transfer is illustrated in FIG. 5. A toner image T on a photoconductor 114 on a photoreceptor drum 112 is not directly transferred onto a support such as a sheet of paper but is first transferred onto an intermediate transfer element 116 such as a silicone belt or a silicone rubber roll, from which the toner image T is retransferred onto the support such as a sheet of paper, typically by application of heat and/or pressure, to thereby obtain a hard copy. If desired, a corona discharge 118 may be applied to the back side of the support. In this method, the transfer of toner image from the photoconductor 114 onto the intermediate transfer element 116 relies basically upon the inherent tendency of the toner particles to adhere to the transfer element such as a silicone rubber roll but the force of their adhesion is generally insufficient to achieve high transfer efficiency. As a result, the toner is not completely transferred onto the transfer element and part of it will remain on the photoconductor 114. The residual toner must be wiped off with a blade 120 but then the same problems that are described above in connection with the conventional electrostatic transfer method will arise. Further, the retransfer of toner image T from the intermediate transfer element 116 onto the support such as a sheet of paper is also incomplete and the transfer efficiency is highly variable depending on electrical properties of paper at the microscopic level or on environmental conditions. As a result, the toner image transferred onto the support such as a sheet of paper is so much uneven in density that it does not cause any problems in producing binary-level images such as characters and line images but not suitable for the case where high fidelity of tone reproduction is required as exemplified by the production of high-contrast continuous-tone image. Under the circumstances, an "adhesive transfer method" which permits the toner image on the photoconductor to be transferred onto an adhesive layer has been proposed as a process that is effective in enhancing and stabilizing the efficiency of toner transfer.

An electrophotographic process that uses the adhesive transfer method for recording continuous-tone image with satisfactory tone reproduction has been disclosed in commonly assigned Japanese Patent Publication (Kokoku) No. 38172/1974. In this process, a latent electrostatic image formed on a photoconductor is developed with a liquid developer (hereinafter sometimes referred to as "a liquid toner") to form a toner image, onto which a sticky (adhesive) tape is compressed and thereafter peeled to separate the toner image, with the peeled tape being subsequently bonded to the final support. The liquid toner comprises fine charged toner particles dispersed in a dielectric fluid. The size of the toner particles is usually in the ragen of 0.1–1.0 μm which is smaller than in dry developers and, therefore, the liquid toner is advantageous for the purpose of recording a continuous-tone image.

When color image is formed by this process with 3 - or 4-colored toner image being transferred onto a single sheet of adhesive tape, the efficiency of toner transfer decreases for the second and subsequent colors. In order to solve this problem, the assignee has proposed improved methods in commonly assigned Japanese Patent Application Nos. 299167/1986 and 73750/1987.

According to those methods, a toner image of the first color is transferred onto a single sheet of adhesive tape, which is then attached to a single support for 3 or 4 colors. These methods are capable of recording color image of high quality and high contrast but, on the other hand, the largeness of the tape thickness imparts unnatural appearance to the final image.

With a view to solving this problem (the adhesive tape for adhesive transfer of toner image is so thick as to make the final image appear unnatural to the viewer), the assignee proposed improved methods in commonly assigned Japanese Patent Application (Kokai) Nos. 253760/1989, 253756/1989, 253757/1989 and 110587/1990. Those methods permit the use of an extremely thin adhesive tape for obtaining satisfactory toner image. According to those methods, a continuous-tone image can be the transfer recorded with fairly good tone reproduction; efficiency is close to 100% but it is still insufficient to produce a continous-tone image of extremely high contrast and quality.

Two other methods have so far been proposed for the purpose of achieving complete transfer of the toner image. The first method has been disclosed in Japanese Patent Application (Kokai) Nos. 174557/1986, 212668/1987 and 4261/1988 and is named a "signature color proofing system". As shown in FIG. 6*a*, this method is characterized by using a PC film 135 comprising a polyethylene terephthalate (PET) base 132 which has formed thereon a transparent conductive layer 133 serving as the ground, which in turn is coated with a light-sensitive OPC (organic photoconductor) layer 130 serving as a photoreceptor and then with an overcoat (OC) layer 131 made of a thermoplastic resin, with the other side of the PET base being provided with a matted backing layer 134. When the PC film 135 is electrified with a corona discharge device, the transparent conductive layer 133 is uniformly charged to negative polarity whereas the OC layer 131 on the light-sensitive OPC layer 130 is uniformly charged to positive polarity (see FIG. 6*b*). In an imagewise exposure step, the PC film 135 is illuminated with light which is applied to the backing layer 134 through an original 136. The exposing light is admitted into the photosensitive layer 130, where charges are eliminated from the illuminated areas and are left only in the unilluminated areas. Upon development with a toner, the particles of toner T will be deposited as shown in FIG. 6*c*. Then, a support 137 such as a sheet of paper is thermocompressed onto the OC layer 131 carrying the toner image T and the PC film 135 is separated into two parts, one including the OC layer 131 and the other including the light-sensitive OPC layer 130, whereupon the toner image T is transferred onto the support 137 together with the OC layer 131. In a color process, the steps of corona charging, exposure and toner development are repeated for the respective colors of interest to form toner images of predetermined colors, say, Y, M, C and B, on the OC layer 131, which toner images are then thermocompressed onto the support. Subsequently, the PC film 135 is separated into two parts as described above and the color toner images are transferred onto the support together with the OC layer 131, thereby forming a desired color image.

This is indeed a method capable of achieving a transfer efficiency of 100%. However, the need to strip the PC film from the light-sensitive layer in each step of transfer makes it impossible to use the photoreceptor repeatedly and the processing cost per hard copy becomes unavoidably high.

The second method has been disclosed in Japanese Patent Application (Kokai) No. 180248/1986 and is named a "LANDA process". This method is characterized by using the particles of a "tentacle toner" which comprises a plurality of fibers having a certain specific morphology. When the latent electrostatic image on the photoconductor on a photoreceptor drum is developed with a liquid toner having the particles of "tentacle toner" dispersed therein, the fibers are physically intertwined, interlocked or interconnected within the developed image as shown in FIG. 7*a*, thereby forming a dense image. In the transfer step, a chain of toner (T) particles are transferred as shown in FIG. 7*b* and it is expected that the toner image can be completely transferred from the photoreceptor drum 140 to the support 142 such as a sheet of paper. As a result, there is high possibility for obtaining a hard copy that carries a toner image T having high resolution and marked contrast.

The toner particles to be used in the second method desirably have such a nature that they will not agglomerate in a dispersion medium composed of a dielectric carrier fluid but that the concentration of those toner particles on the photoconductor will increase only when the toner image is formed, thereby permitting the toner particles to be interlocked or interconnected with a stronger force. In practice, however, it is difficult for one and the same toner particle to possess those incompatible properties. Hence, those toner particles have an inherent tendency to agglomerate in the dispersion medium, which presents considerable difficulty in handling the toner since the agglomerated toner particles are highly prone to settle. In other words, the toner particles described above have a great tendency to settle when they are not in use and in order to use them, the toner particles must be thoroughly redispersed by suitable means such as agitation.

BRIEF DESCRIPTION OF THE INVENTION

The present invention has been achieved under these circumstances and has an as object providing a method of forming an image by electrophotography using a adhesive transfer process, in which method a toner image formed on the photoconductor on a photoreceptor drum is completely adhesive-transferred onto an intermediate transfer element having an adhesive layer, with the transferred toner image on the adhesive layer also being completely retransferred onto a final support such as a sheet of paper or film in a complete and yet easy and simple way, thereby forming a continous-tone image of high contrast and quality, and which method also permits the intermediate transfer element to be used repeatedly so as to reduce the processing cost per image forming cycle.

This object of the present invention consists, in fact, of two aspects. The first aspect of the object is to insure that the toner image formed on the photoconductor on a photoreceptor drum is completely adhesive-transferred onto the intermediate transfer element having an adhesive layer. The second aspect of the object is to insure that the toner image transferred onto the adhesive layer is also completely retransferred onto the final support such as a sheet of paper or film in a complete and yet easy and simple way while permitting the repeated use of the intermediate transfer element. The present inventors conducted intensive studies in order to attain these two aspects of the object of the present invention and, as a result, obtained the following observations, on the basis of which the present invention has been accomplished.

In order to attain the first aspect of the object of the present invention, i.e., to insure that the toner image formed on the photoconductor on a photoreceptor drum is completely transferred onto an intermediate transfer element having an adhesive layer, the photoconductor on the electrophotographic photoreceptor drum should be an a-Si (amorphous silicon) photoconductor having a SiC surface, and the toner particles should be coated with a polymer having a cohesive energy constant G [the cohesive energy constant G of a polymer coat as calculated using the values of cohesive energy constant G of atoms and atomic groups which are described by P. A. Small in J. Appl. Chem., 3, 71 (1953)] of at least 280, and the peeling force, or the force by which the toner deposited on the photoconductor is completely separated from the latter together with the adhesive layer on the intermediate transfer element, should be no more than 130 g per width of 25 mm.

In order to attain the second aspect of the object of the present invention, i.e., to insure that the toner image transferred onto the adhesive layer is retransferred onto the final support such as a sheet of paper or film in a complete and yet easy and simple way while permitting the repeated use of the intermediate transfer element, the toner should satisfy the above-described condition for cohesive energy constant G, the adhesive layer should contain a urethane (meth)acrylic resin as a main component, the toner image transferred onto the adhesive layer should be thermocompressed onto the final support, and by subsequent separation of the final support from the adhesive layer at an appropriate temperature, the toner image on the adhesive layer should be completely retransferred onto the final support.

These conditions can be satisfied by an electrophotographic image forming method which comprises the steps of forming a toner image on the photoconductor on an electrophotographic photoreceptor drum by electrophotography, tack-transferring said toner image onto the adhesive layer of an intermediate transfer element and then retransferring said toner image onto a support to form a final image, which method is characterized in that the photoconductor on said electrophotographic photoreceptor drum is an a-Si (amorphous silicon) photoconductor having a SiC (silicon carbide) surface, that the toner particles are coated with a polymer having a cohesive energy constant G of at least 280, that the adhesive layer of said intermediate transfer element is formed from an adhesive that is based on a urethane (meth)acrylic resin and which further contains at least one member selected from among an acrylic rubber, a saturated polyester resin and a fluorine-containing additive.

Preferably, the peeling force required to peel the deposited toner particles from said photoconductor together with said adhesive layer is no more than 130 g per width of 25 mm.

Preferably, the peeling force required to peel the deposited toner particles from said photoconductor together with said adhesive layer is no more than 70 g per width of 25 mm.

Preferably, the peeling force required to peel the deposited toner particles from said photoconductor together with said adhesive layer is no more than 30 g per width of 25 mm.

Preferably, said urethane (meth)acrylic resin is formed of at least one member selected from the group consisting of a urethane acrylic monomer, a urethane acrylic oligomer, a urethane methacrylic monomer and a urethane methacrylic oligomer.

Preferably, said adhesive layer contains a reaction initiator.

Preferably, said reaction initiator is a thermal reaction initiator.

Preferably, said intermediate transfer element and said final support are thermocompressed to each other.

Preferably, said final support is compatible with said toner coating polymer.

Preferably, said coating polymer is at least one member selected from the group consisting of a styrene-butadiene copolymer, a methyl methacrylate-stearyl methacrylate copolymer and an ethylene-methacrylic acid copolymer.

Preferably, said toner coating polymer has a cohesive energy constant G of at least 500.

Preferably, said toner coating polymer has a cohesive energy constant G of at least 700.

DETAILED DESCRIPTION OF THE DRAWINGS

The present invention is described below in greater detail.

The present invention satisfies both the conditions for insuring that the toner particles deposited on a photoconductor are transferred substantially completely onto the adhesive layer of the intermediate element (the first aspect of the object of the invention) and the conditions for insuring that the toner image transferred onto the adhesive layer is completely retransferred onto the final support such as a sheet of paper or film (the second aspect of the object of the invention).

The conditions to be satisfied for achieving the first aspect of the object of the present invention are described below.

The present invention has been accomplished as a result of the extensive studies conducted to identify the conditions for insuring that the toner particles deposited on the photoconductor are completely transferred onto the adhesive layer.

Figure 1A:
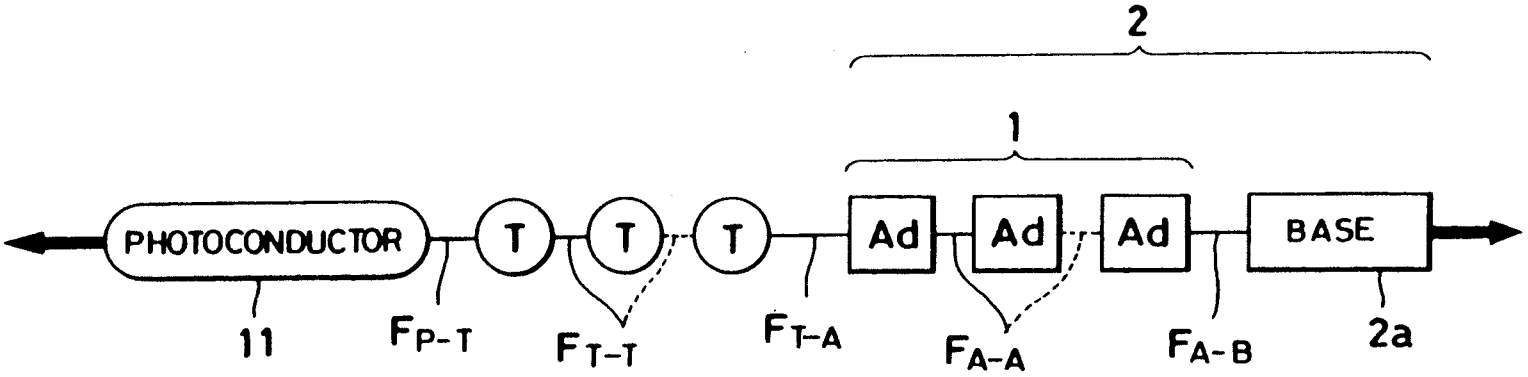
FIGS. 1*a* and 1*b* are schematic diagrams illustrating the peeling processes involved in the image forming method of the present invention.

Compressing the adhesive layer onto the toner particles deposited on the surface of a photoconductor and peeling them off together with the adhesive layer may be shown schematically as illustrated in FIG. 1*a*, where $F_{P-T}$ represents the adhesive force between the surface of the photoconductor 11 and the deposited toner particles T; $F_{T-T}$, the cohesive force between individual toner particles T; $F_{T-A}$, the adhesive force at the interface between the adhesive layer 1 and the toner particles T; $F_{A-A}$, the cohesive force of the adhesive layer 1; and $F_{A-B}$, the force of bonding between the adhesive layer 1 and the base 2*a*.

Referring to FIG. 1*a*, when the assembly including the photoconductor 11 and the base 2*a* is pulled with strong force in opposite directions as indicated by arrows, a breakage occurs in the area where the binding force is the weakest. Hence, the condition for insuring that the toner particles T deposited on the photoconductor 11 are completely transferred onto the adhesive layer 1 is that $F_{P-T}$ be smaller than any one of $F_{T-T}$, $F_{T-A}$, $F_{A-A}$ and $F_{A-B}$. If this condition is met, a breakage occurs between the photoconductor 11 and the toner particles T that are the closest to the photoconductor 11, whereby all the toner particles can be transferred onto the adhesive layer 1.

In the peeling process just described above, if the adhesive layer 1 is an adhesive film that is bonded to the base 2*a* with adequately strong force and that comprises adhesive particles Ad having an adequate cohesive force and if said film has an adequately strong bonding force with respect to the toner particles T, the success of 100% transfer of the toner particles T from the photoconductor 11 is entirely dependent upon whether the relationship of $F_{P-T}<F_{T-T}$ is satisfied. Needless to say, it is most desirable to measure $F_{P-T}$ and $F_{T-T}$ directly but in the practice of electrophotographic processes, it is very difficult to measure the cohesive force of toner particles T that build up on the photoconductor 11 and no reliable method for measurement has yet been known. As an alternative, the cohesive energy constant G proposed by P. A. Small [see J. Appl. Chem. 3, 71 (1953)] is adopted in the present invention and the cohesive energy constant G of the polymer coat on the toner particles has been determined by calculation. As regards $F_{P-T}$, the measurement of peeling force was conducted in the manner to be described later in this specification. Toner samples were prepared using various coating polymers and the conditions for insuring complete peeling of the toner from the photoconductor were reviewed. As a result, it was found that when the toner particles were coated with a polymer having a cohesive energy constant G of at least 280 and when the force required to cause complete toner peeling from the photoconductor was no more than 130 g per width of 25 mm, all the toner particles on the photoconductor could advantageously be transferred onto the adhesive layer. Part of the present invention has been accomplished on the basis of this finding.

The conditions to be satisfied for achieving the second aspect of the object of the present invention are described below.

Figure 1B:
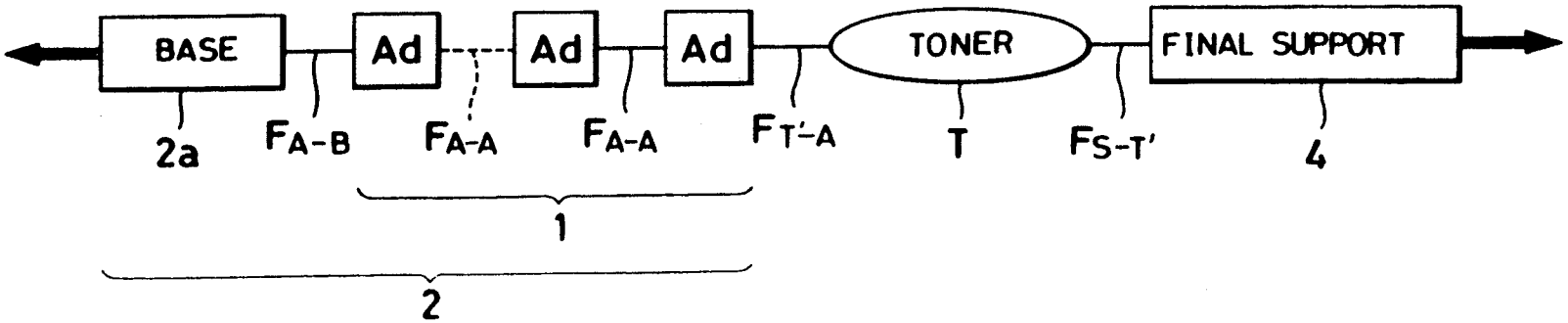

Consider here the case where an adhesive film having an adhesive layer is used as the intermediate transfer element. If the adhesive film having toner particles deposited on the adhesive layer is thermocompressed to the final support at a temperature not lower than the softening point of the polymer coat on the individual toner particles and if it is later cooled to a temperature below said softening point so that it can be stripped from the final support, the peeling process involved in this retransfer step may be shown schematically as illustrated in FIG. 1*b*, where $F_{S-T}$ represents the force of adhesion between the final support 4 and the deposited toner particles T; $F_{T-A}$, the force of adhesion at the interface between the toner particles T and the adhesive layer 1; $F_{A-A}$, the cohesive force of the adhesive layer 1; and $F_{A-B}$, the force of bonding between the adhesive layer 1 and the base 2*a*. Since the toner image T building up on the adhesive layer 1 is thermocompressed at a temperature not lower than the softening point of the polymer coat on the individual toner particles, those toner particles will fuse together to form a single mass of the polymer and, hence, the cohesive force of the individual toner particles is very great and need not be considered for the purpose of the present discussion with reference to FIG. 1*b*.

Referring to FIG. 1*b*, when the assembly including the base 2*a* and the final support 4 is pulled with strong force in opposite directions as indicated by arrows, a breakage occurs in the area where the binding force is the weakest. Hence, the condition for insuring that the toner image T on the adhesive film 2 is completely transferred onto the final support 4 is that $F_{T-A}$ be smaller than any of $F_{S-T}$, $F_{A-A}$ and $F_{A-B}$. If this condition is met only the toner image T on the adhesive film 2 will be completely transferred onto the final support 4.

In the retransfer process just described above, if the adhesive layer 1 is bonded to the base 2*a* with adequately strong force and if the adhesive particles Ad have an adequately strong cohesive force, namely, if $F_{T-A}<F_{A-B}$ and $F_{T-A}<F_{A-A}$, the condition for insuring that the toner image on the adhesive film 2 is completely retransferred onto the final support is that $F_{T-A}$ be smaller than $F_{S-T}$ ($F_{T-A}<F_{S-T}$). This means that if $F_{S-T}$ is increased by making the topmost surface of the final support 4 from a material that is compatible with or identical to the toner coating polymer and if $F_{T-A}$ is reduced to an appropriately small value by using incompatible materials for the adhesive Ad and the toner coating polymer, an adhesive can be obtained that satisfies the condition of $F_{T-A}<F_{S-T}$ in the retransfer step.

The present inventors found that an adhesive containing a urethane (meth)acrylic resin as a main component satisfied the above-specified condition for successful retransfer and also found that complete transfer of the toner image could advantageously be achieved by using an adhesive layer comprising that adhesive. The present invention has been totally accomplished on the basis of these findings.

The intermediate transfer element to be used in the present invention is described below in detail.

The intermediate transfer element to be used in the present invention comprises a base and an adhesive layer that is provided on it for carrying a toner image before it is retransferred onto the final support. The intermediate transfer element may assume various shapes including a sheet, tape, film and a cylindrical drum. The base of the intermediate transfer element may be formed of any material as long as it works as the support of the adhesive layer (i.e., if the adhesive is strongly bonded to the base, or $F_{A-B}$ is adequately large), and it may be formed of a sheet of paper, a polyethylene terephthalate film, etc., which have a thickness of ca. 10–300 μm.

The adhesive layer of the intermediate transfer element is particularly important for the purposes of the present invention and it preferably has the following capabilities: (i) the toner image formed on the photoconductor on a photoreceptor drum can be completely adhesive-transferred onto the adhesive layer of the intermediate transfer element; (ii) the toner image transferred onto the adhesive layer can be completely retransferred onto the final support; and (iii) steps (i) and (ii) can be repeated with the same adhesive layer.

The adhesive that can be used to form the adhesive layer having the properties described above is an adhesive composition that contains a urethane (meth)acrylic resin as a main component, with an acrylic rubber (i.e., a copolymer of a non-adhesive acrylic acid ester), a saturated polyester resin or a fluorine-containing additive being incorporated in a minor amount.

The urethane (meth)acrylic resin used as the main component of the adhesive is a polymer of an acrylic monomer, an acrylic oligomer, a methacrylic monomer or a methacrylic oligomer and has a polyurethane backbone chain with a (meth)acryloyl group present at a terminal end or terminal ends of the molecule or in side chains thereof.

The acrylic rubber that may be used as the non-adhesive component of the adhesive is a polymer that contains an acrylic acid ester as a main component. Particular advantages of the acrylic rubber include high resistance to heat, aging and weathers, as well as good solubility in organic solvents. The saturated polyester resin that may also be used as the non-adhesive component has high resistance of light, high wear resistance and good bonding properties. These properties of the non-adhesive components can be further improved by adding a crosslinking agent such as an isocyanate. These non-adhesive components may optionally contain a tackifier such as a rosin, a terpene resin or a hydrocarbon resin.

The adhesive may also contain a fluorine-containing additive. The fluorine-containing additive improves the release of the toner image from the adhesive layer, and thus it has been easily retransferred onto the final support. Although this component is not essential, it is preferably incorporated in order to facilitate complete retransfer of the toner image. Examples of the fluorine-containing additive that can be used include a trifluoroethylene polymer, a tetrafluoroethylene polymer, a fluorine-containing surfactant, etc.

While the above-described components are incorporated in appropriate amounts in the adhesive, the preferred relative proportions are typically such that the urethane (meth)acrylic resin and the fluorine-containing additive are used in amounts of 50–90 parts by weight and 0–40 parts by weight, respectively, with the non-adhesive component being used in an amount of 10–50 parts by weight. If the fluorine-containing additive is a fluorine-containing resin or high-molecular weight compound, it is preferably used in an amount of 0–40 parts by weight and in the case of a fluorine-containing surfactant or low-molecular weight compound, it is preferably used in an amount of 0–5 parts by weight.

The adhesive composition can be prepared by mixing the above-described components uniformly in the usual manner. If desired, a crosslinking agent, a plasticizer a filler and any other appropriate additives may be incorporated.

The thus prepared adhesive composition is coated on a film base in a thickness of 5–20 μm on a solids basis, whereby an adhesive film, tape or sheet is produced which is suitable for use as the intermediate transfer element in the present invention.

The intermediate transfer element having an adhesive layer made of the adhesive described above insures that a toner image is adhesive-transferred from the photoconductor almost completely and that it can be subsequently retransferred completely onto the final support. It has the additional advantage that after the retransfer step, it can be repeatedly used in successive cycles of adhesive transfer and complete retransfer of the toner image.

An example of the adhesive that can be used in the intermediate transfer element in the present invention is described in working examples of the invention disclosed in Japanese Patent Application No. 266900/1987 but the present invention is in no way limited to this particular example.

The final support to be used in the present invention may be of any type as long as the toner image transferred onto the adhesive layer in the intermediate transfer element can be thermocompressed onto the final support and if said toner image can be completely retransferred onto the final support upon subsequent separation of the adhesive layer from the final support at an appropriate temperature. The support may be transparent or opaque. If the support is a tansparent film, a negative or positive print image for viewing with transmitted light can be formed; in the case of an opaque paper or film, a print image for viewing with reflected light can be formed. Typical examples of the final support that can be used in the present invention include Xerox OHP sheets, latex-coated paper (product of Mitsubishi Paper Mills, Ltd.), enamel-coated paper (Oji Paper Co., Ltd.), and plain paper such as the one used in xerography.

These supports have a certain toner receiving layer for insuring that the transferred toner image will be securely fixed on the final support. The toner receiving layer may be formed of the asperities that result from paper fibers on the support surface as in the case of plain paper such as xerographic paper or it may be a coated or laminated layer of a material that is formed to improve the adhesion to toner as in the case of coated paper and coated films.

In the present invention, enhanced adhesion between the toner and the final support is an essential condition for complete retransfer of the toner image. Hence, the final support preferably has a toner image receiving layer as mentioned above so that the toner image can be firmly fixed to its surface.

The photoconductor provided on the circumference of the photoreceptor drum to be used in the present invention may be of any type that is commonly used in electrophotography and that has the following characteristics: it can be uniformly charged by corona discharge or some other suitable means; a latent electrostatic image can be formed in exact correspondence to image information by illumination with a light beam carrying that image information; a toner image for continuous-tone image can be produced by development with a liquid developer; and the toner can be easily peeled if the adhesive layer on the base of the intermediate transfer element is pressed and subsequently detached. The photoconductor to be used in the present invention is preferably an a-Si (amorphous silicon) photoreceptor having its surface coated with SiC (silicon carbide). Other photoconductors as exemplified by organic photocondutors (OPC), selenium photoreceptors, selenium alloy photoreceptors, cadmium sulfide photoreceptors and multilayered photoreceptors made of composites of these materials may also be used in the present invention as long as they satisfy the conditions set forth above.

The liquid developer to be used in the present invention for forming a toner image is composed of a pigment, a coating agent, a dispersant, a fixing agent, a charge control agent and a dielectric carrier fluid but other ingredients may be added without departing from the scope and spirit of the present invention.

Many known inorganic and organic pigments including carbon black may be used as pigment components of the liquid developer.

Any dielectric carrier fluid can be used as long as it has an electric resistance of at least $10^{10}$ Ω cm and low dielectric constant (in order to avoid the leakage of a latent electrostatic image), has no toxicity and will not attack the photoreceptor. Preferred examples of such dielectric carrier fluids include normal paraffinic, isoparaffinic, olefinic and naphtha-based liquid hydrocarbons, which may optionally contain aromatic hydrocarbons. More preferred examples are "Isopar G", "Isopar H", "Isopar L" and "Solvesso" which are commercially available from Esso Standard Co. These hydrocarbons may be used either singly or in admixtures.

The coating agent is used to coat the pigment particles and, as it is used in the present invention, the coating agent is compatible with the toner receiving layer of the final support. The coating agent is an important factor for insuring that the toner image formed on the photoconductor is transferred onto the adhesive film almost completely, preferably completely, when the adhesive layer provided on the base of the adhesive film is pressed against the toner image which is subsequently peeled from the photoconductor to perform adhesive transfer.

To state more specifically, the individual toner particles are coated with the coating agent to be described below, so the vicinal interaction of individual toner particles is produced by the coating agent and it is assumed that the cohesive energy constant G of the toner particles is largely dependent on the associated coating agent. As regards the force of adhesion that acts between the photoconductor and adjacent toner particles would largely be attributable to the constituent material of each toner particle that is in contact with the surface of the photoconductor, namely, to the coating agent of the toner particle. This is because as already shown in the schematic diagram of FIG. 1*a*, $F_{P\text{-}T} < F_{T\text{-}T}$ is the principal condition for insuring complete (100%) transfer of toner particles and the toner coating agent would largely contribute to respective the values of $F_{P\text{-}T}$ and $F_{T\text{-}T}$.

The present inventors conducted extensive studies on toner samples that were coated with various kinds of polymers. As a result, it was found that polymers advantageous for use as toner coating agents in the present invention had a cohesive energy constant G of at least 280 as calculated using the values of cohesive energy constant G of atoms or atomic groups which were proposed by P. A. Small. More preferably, the toner coating polymer to be used in the present invention has a cohesive energy constant G of at least 500, with values of 700 and above being particularly preferred.

At the same time, in order to evaluate $F_{P\text{-}T}$, or the force of adhesion acting between the surface of the photoconductor and the toner particles deposited thereon, the present inventors measured the peeling force by which toner samples coated with various polymers could be peeled from the a-Si photoconductor having a SiC surface by the method to be described hereinafter. As a result, it was found that advantageous coating polymers were those which had a peeling force of no more than 130 g, more preferably not more than 70 g, particularly preferably not more than 30 g, per width of 25 mm.

Typical examples of the coating polymer that meets those conditions and which hence are preferred for use in the present invention include styrene-butadiene copolymers, methyl methacrylate-stearyl methacrylate copolymers and ethylene-methacrylic acid copolymers. These are not the sole examples of the coating polymer that can be used in the present invention and any other coating agents may be used as long as they have a cohesive energy constant G of at least 280 when measured in the manner described above and if toners coated with those agents can be peeled from the photoconductor with a force not greater than 130 g per width of 25 mm.

The dispersant may be of any known type as long as it effectively prevents toner particles from agglomerating and settling in the dielectric carrier fluid. The charge control agent is adsorbed on toner particles in the dielectric carrier fluid and determines the polarity and quantity of electric charges to be deposited on the toner particles. For this purpose, any known charge control agents may be used as exemplified by organic metal salts that are soluble in the dielectric carrier fluid, as well as linseed oil and synthetic resins that have electron donating or electron accepting polar groups. The fixing agent is incorporated in order to improve the fixability of toner image and it is essential for the fixing agent to be deposited on toner particles in the liquid toner. Hence, the fixing agent is a factor that is as important as the toner coating agent.

The term "coating agent" as used herein means both the coating polymer and the fixing agent that are deposited on toner particles. Therefore, if the coating polymer and the fixing agent are used at the same time in the present invention, their total cohesive energy is expressed as the sum of the cohesive energies of the respective components multiplied by their mol fractions.

On the pages that follow, the image forming method of the present invention is described in detail with reference to the preferred embodiment shown in accompanying drawings.

Figure 2:
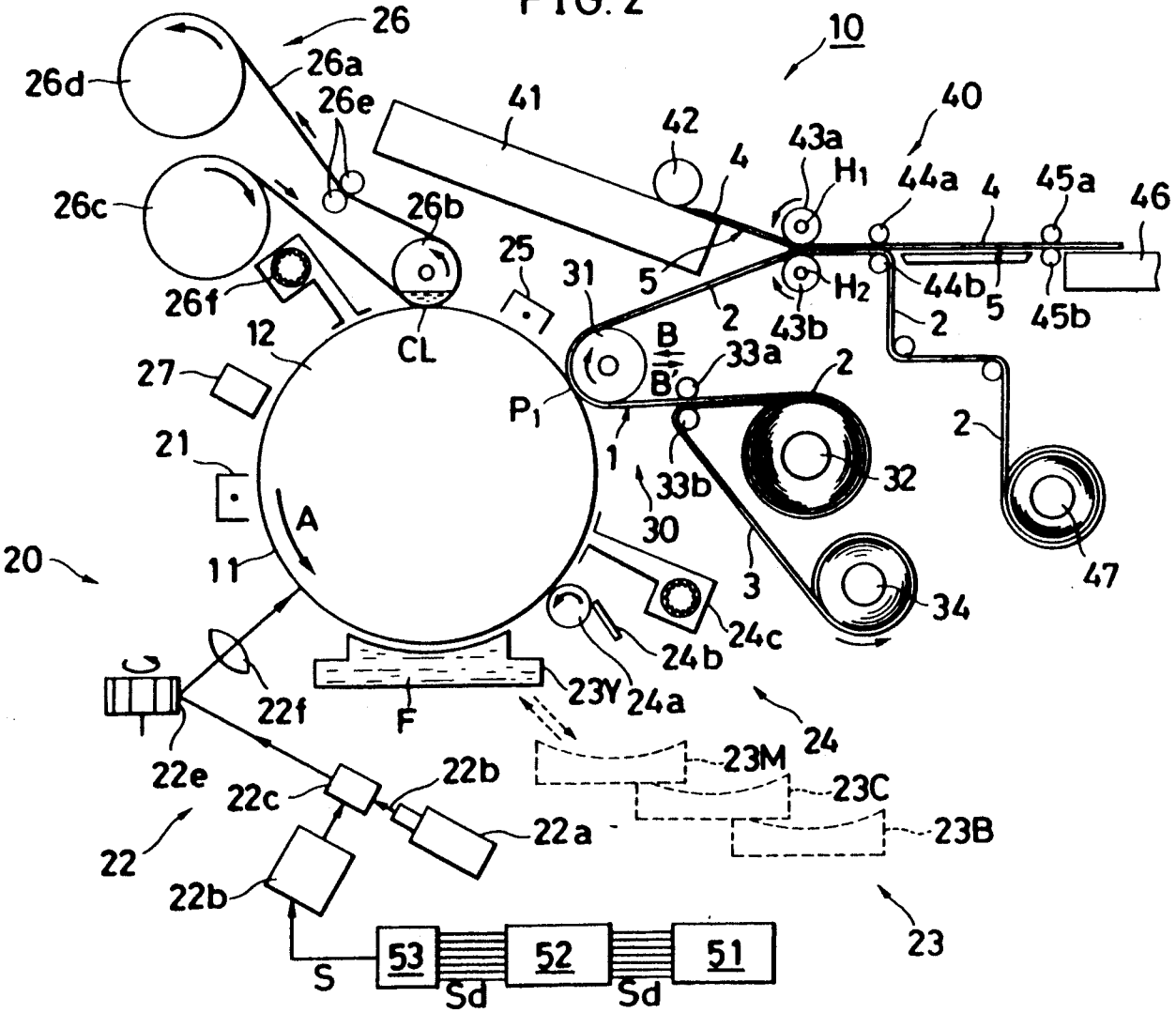
FIG. 2 is a diagram showing schematically an example of the electrophotographic apparatus that may be used to implement the image forming method of the present invention.

FIG. 2 is a diagram showing schematically an example of the electrophotographic apparatus that may be used to implement the image forming method of the present invention. The electrophotographic apparatus generally indicated by 10 in FIG. 2 has a photoreceptor drum 12 which is provided with a photoconductor 11 on its circumference. As the drum rotates in the direction of arrow A, a toner image is formed on the peripheral surface of the drum by a toner image forming means 20 which is provided above the circumference of the drum. Basically, the toner image forming means 20 comprises, in the direction A in which the drum rotates, a charging device 21, an exposing unit 22, a developing unit 23, a drum drying means 24, an erasing device 25 and a cleaning means 26.

The exposing unit 22 comprises the following components: a laser light source **22*a* typically in the form of a semiconductor laser or a He-Ne laser; a light modulator 22c such as an AOM (acoustooptic modulator) which performs intensity modulation on a light beam (laser beam) 22b issuing from the laser light source 22a; a modulator circuit 22d that drives the light modulator 22c; a light deflector 22e such as a polygonal mirror which reflects and deflects the modulated light beam 22b in such a way that it is scanned over the photoreceptor drum 12 in a direction generally perpendicular to the direction of its rotation (as indicated by arrow A); and a scanning lens 22f in the form of an f8 lens that converges the light beam 22b to produce a uniform beam spot on the photoreceptor drum 12. The light modulator 22c is connected to the modulator circuit 22d. A digital image signal Sd as supplied from an image signal feeder 51 is corrected in a correcting table 52 and the corrected image signal is converted to an analog image signal S in a D/A converter 53. In response to the analog image signal S, the modulator circuit 22d drives the light modulator 22c**.

The developing unit 23 may be any wet developing unit that is capable of supplying the latent electrostatic image on the photoconductor 11 with a liquid developer (liquid toner) F which, as already described above, has fine charged toner particles dispersed in the dielectric carrier fluid. A typical example is the liquid developing unit described in commonly assigned Japanese Patent Application No. 52216/1986.

The liquid developer F may have the composition already described above.

The apparatus shown in FIG. 2 is so designed that in the formation of a color image, three-color wet developing units, i.e., 23Y that uses a yellow (Y) toner, 23M that uses a magenta (M) toner, and 23C that uses a cyan (C) toner, or four-color wet developing units 23Y, 23M, 23C and 23B that uses a black (B) toner, can be successively replaced by one another.

The drying means 24 has a squeeze roller 24a and a blade 24b. The squeeze roller 24a rotates in the direction indicated by arrow (in the rotational direction A of the photoreceptor drum 12) but at a faster speed without contacting the drum, whereby not only the toner particles but also the dielectric fluid which is deposited on the photoconductor is wiped off. The blade 24b rubs off the dielectric fluid that has been wiped from the photoconductor by means of the squeeze roller 24a. while the dielectric fluid can be practically removed by the combination of the squeeze roller 24a and the blade 24b, the drying means 24 is further equipped with a dryer 24c that supplies hot or warm air for drying the squeeze roller 24a and the toner image remaining on the photoconductor 11. If necessary, more than one unit of the dryer 24c may be provided so that the squeeze roller 24a is dried with one unit whereas the residual toner image on the photoconductor 11 is dried with another unit.

The cleaning means 26 cleans the outer surface of the photoconductor 11 on the photoreceptor drum 12 after the transfer step and comprises the following components: a flexible cloth 26a impregnated with a cleaning fluid CL such as the dielectric carrier fluid used in the liquid developer; a compression roller 26b that compresses the flexible cloth 26a onto the surface of the photoconductor 11 on the photoreceptor drum 12 and which allows said cloth 26a to be impregnated with the cleaning fluid CL; a first roller 26c for unwinding the virgin flexible cloth 26a; a second roller 26d for winding up the used flexible cloth 26a; a tension roller 26e; a dryer 26f that dries up the cleaned surface of the photoconductor 11; and a known drive means (not shown).

In the present invention, the toner image on the photoconductor 11 is completely transferred onto the adhesive layer of the intermediate transfer element, so it is not absolutely necessary to provide the cleaning means 26. However, in order to insure that the surface of the photoconductor is kept always clean before it is uniformly charged, the cleaning means is preferably provided.

The apparatus shown in FIG. 2 also includes a adhesive-transfer means 30 which comprises the following components: a hollow transfer roller 31 that is movable by a known means in two opposite directions B and B' to take either the position where it is urged against the photoconductor 11 on the circumference of the photoreceptor drum 12 when it is moved in direction B, or the position where it is spaced apart from the photoconductor 11 when it is moved in direction B'; a supply roller 32 onto which is wound an image-receiving sheet 2 that is attached on one side to a strip of release paper or film (hereinafter referred to as a "release sheet") 3 and which has on the other side the adhesive layer 1 of the intermediate transfer element; nip rollers 33a and 33b which hold between them the image-receiving sheet 2 that is attached to the release sheet 3 and which is being unwound from the roller 32; and a takeup roller 34 which winds up the release sheet 3 as it is peeled from the image-receiving sheet 2 held between the nip rollers 33a and 33b.

As typically shown in FIG. 3d, the image-receiving sheet 2 is composed of the adhesive layer 1 which is supported on a base 2a in the form of a film or tape.

A means 40 for effecting retransfer of toner image onto the support which is the most characteristic part of the present invention is provided downstream of the transfer roller 31. The retransfer means 40 comprises the following components: a final support stocker 41 in which the support 4 having a toner receiving layer 5 is stored with the toner receiving layer 5 facing down; a final support delivery roller 42 provided in the vicinity of the exit of the support stocker 41; a pair of thermocompression transfer rollers 43a and 43b by which the support 4 delivered by means of the roller 42 in timed relationship with the image-receiving sheet 2 is thermocompressed onto the latter in such a way that the toner receiving layer 5 faces the toner image T on the adhesive layer 1 of the image-receiving sheet 2; nip rollers 44a and 44b that hold between them the thermocompressed support 4 and image-receiving sheet 2; nip rollers 45a and 45b that hold and transport the support 4 which has only the toner image T transferred onto the toner receiving layer 5 by passage between the nip rollers 44a and 44b; a tray 46 into which the support carrying the toner image T is recovered; and a takeup roller 47 for winding up the image-receiving sheet 2 composed of the adhesive layer 1 and the base 2a so that it can be used again after the transfer.

The thermocompression transfer rollers 43a and 43b have heat sources $H_1$ and $H_2$, respectively, in their interior so that they can be heated to a predetermined temperature. Those rollers are rotated by drive means (not shown) in opposite directions as indicated by arrows.

In the example shown in FIG. 2, the release sheet 3 is used to protect the adhesive layer 1 of the image-receiving sheet 2 but this is not absolutely necessary and may be omitted by imparting a release property to the back side of the image-receiving sheet 2. If the release sheet 3 is to be used in supplying the image-receiving sheet 2, a release sheet supply roller may be provided so that the release sheet 3 can be inserted between layers of the used image-receiving sheet 2 while it is taken up by the roller 47.

The arrangement of components including rollers as it relates to the process starting with the supply of the image-receiving sheet 2 and ending with it being wound up may be designed in various ways for permitting the image-receiving sheet 2 to be used cyclically. For example, an endless loop of the components may be adopted. Alternatively, the image-receiving sheet 2 may be put another use by reversing the rotation of the supply roller 32 and the takeup roller 47.

Figure 3:
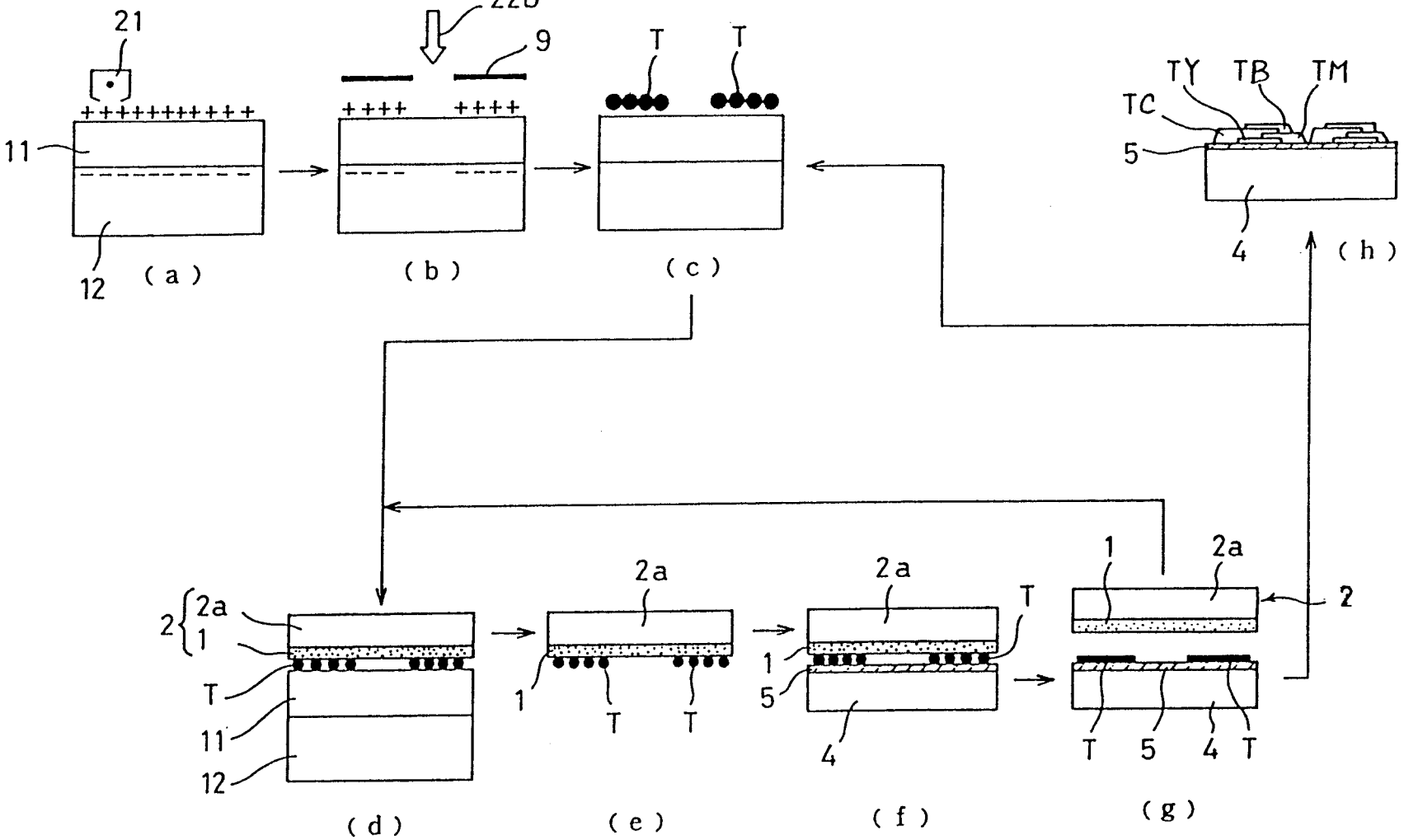
FIGS. 3*a*–3*h* are diagrams showing schematically the image forming process as it relates to the successive steps of the image forming method of the present invention.

The electrophotographic apparatus 10 having the construction described above and which is used to implement the image forming method of the present invention forms a print image by the following procedure, which is described below with reference to the print image forming process shown schematically in FIGS. 2 and 3.

When recording an image on the photoreceptor drum 12 in the apparatus shown in FIG. 2, the drum 12 is rotated in the direction of arrow A and, at the same time, a digital image signal Sd carrying continuous-tone image information is supplied from the image signal feeder 51; the signal Sd is corrected in the correction table 52 and thence supplied into the D/A converter 53 where it is converted to an analog image signal S, which is then supplied into the modulator circuit 22*d*. In response to the image signal S, the modulator circuit 22*d* drives the light modulator 22*c*, whereupon the light beam 22*b* is intensity-modulated in accordance with the image signal S.

When the photoreceptor drum 12 rotates in the direction of arrow A, the photoconductor 11 makes a relative movement to the charging device 21 which forms a uniform charge layer on the photoconductor surface as shown in FIG. 3*a*. The uniformly charged photoconductor 11 is exposed as shown in FIG. 3*b* by illumination with a light beam 22*b* that has issued from the laser light source 22*a* and that has been deflected by the light deflector 22*e*.

In FIG. 3*b*, the state of exposure is shown only schematically for the sake of clarity, with no mask being located in the area which is illuminated with the light beam 22*b* but a mask 9 being present in the unilluminated area.

By deflection with the light deflector 22*e*, the light beam 22*b* is scanned one-dimensionally over the photoconductor 11 (it is scanned at fast speed). At the same time, the rotation of the photoreceptor drum 12 in the direction A causes the light beam 22*b* to be scanned at slow speed, whereby the photoreceptor drum 11 is scanned two-dimensionally with the light beam 22*b*. As already mentioned, the light beam 22*b* has been modulated with the image signal S and, hence, a latent electrostatic image corresponding to the image information carried by the image signal S is formed, as shown in FIG. 3*b*, on the photoconductor 11 upon illumination with the light beam 22*b*.

The latent electrostatic image is developed in the wet developing unit 23 to form a toner image T as shown in FIG. 3*c*. In the wet developing unit 23, the liquid developer F having fine charged toner particles T dispersed in a dielectric carrier fluid is brought into contact with the photoconductor 11 and the toner particles are deposited on the photoconductor 11 by electrostatic attraction, whereby the latent electrostatic image is rendered visible.

The thus formed toner image T has the lower density in areas that have been illuminated with the light beam 22*b* having the higher intensity, whereby the continuous tone of the image information carried by the image signal Sd is reproduced. After the toner development, the photoreceptor drum 12 makes a further rotation in the direction of arrow A and the toner image T is dried by the drum drying means 24.

The image-receiving sheet 2 as it is attached to the strip of release sheet 3 is delivered from the supply roller 32 and separated form the release sheet 3 in the position where it is held between the nip rollers 33*a* and 33*b*. The stripped release sheet 3 is wound up by the takeup roller 34. The image-receiving sheet 2 stripped of the release sheet 3 is transported by the transfer roller 31 with the adhesive layer 1 facing outward.

When the toner developed area of the photoconductor 11 has been transported to a location immediately before the position where it faces the transfer roller 31, this event is detected or identified by a known means, whereupon the transfer roller 31 which has been kept away from the photoreceptor drum 12 is moved in direction B to position $P_1$ where it is pressed against the photoreceptor drum 12. When the transfer roller 31 moves in this way, it rotates as the follower of the photoreceptor drum 12 and the image-receiving sheet 2 wound onto the roller 31 is pressed in such a way that the adhesive layer 1 of the sheet is urged against the photoconductor 11 as shown in FIG. 3*d*.

If the force of adhesion between the toner particles forming the toner image T and the photoconductor 11 is adjusted to be smaller than each of the force of adhesion between the adhesive layer 1 and the toner particles T and the cohesive force of individual toner particles T, the adhesive layer 1 of the image-receiving sheet 2 only needs to be lightly pressed against the photoconductor 11 to insure that all the toner particles T are peeled in a complete and easy way to be transferred onto the adhesive layer 1 of the image-receiving sheet 2. Thus, the toner image T on the photoconductor 11 is entirely adhesive-transferred onto the adhesive layer 1 of the image-receiving sheet 2 as shown in FIG. 3*e*.

Subsequently, the transfer roller 31 is moved in direction B' to be spaced apart from the photoreceptor drum 12. The image-receiving sheet 2 carrying the toner image T that has been adhesive-transferred from the photoconductor 11 is fed into the nip between the pair of heated thermocompression rollers 43*a* and 43*b*, whereupon said sheet 2 and the support 4 having the toner receiving layer 5 which has been delivered from the support stocker 41 in timed relationship with said sheet by means of the roller 42 are put together in such a way that the adhesive layer 1 will face the toner receiving layer 5. The image-receiving sheet 2 and the support 4 which have been put together are thermocompressed as they are passed between the rollers 43*a* and 43*b*. Thereafter, the assembly is transported to the gap between the nip rollers 44*a* and 44*b* while it is cooled down.

In the process described above, the toner T is melted by thermocompression and the individual toner particles are fused together; at the same time, toner particles are fixed firmly to the toner receiving layer 5 by, for example, getting into the surface asperities. As a result, the cohesive force of individual toner particles (i.e., the force required to have one toner particle to adhere to another) will increase to thereby enhance the force of adhesion between the fixed toner image T and the support 4. The enhancement is particularly great if a material that helps increase the toner adhesion by a suitable means such as thermocompression is incorporated in the toner receiving layer 5 of the support 4.

The temperature and pressure for thermocompression may be properly determined by various factors including the types of toner, adhesive layer and final support used. The heating temperature must not be lower than the softening point of the toner coating polymer and it is preferably in the range of 120°-150° C. The pressure for thermocompression is preferably in the range of 0.05-0.8 kg/cm$^2$.

In a subsequent step, the final support 4 is stripped from the image-receiving sheet 2 by passage between the nip rollers 44*a* and 44*b*. In this case, the force of adhesion between toner particles T and the adhesive layer 1 must be smaller than each of the cohesive force of individual toner particles and the force of adhesion between the toner T and the final support 4. To meet this requirement, the conditions of cooling which follows the thermocompression or cooling with the nip rollers 44*a* and 44*b* must be set in an appropriate manner. The temperature at the nip rollers 44*a* and 44*b* may be determined as appropriate for various factors including the types of toner, adhesive layer and final support used but the preferred range is from 80° to 120° C.

After the steps of thermal fixing and cooling, the toner image T on the adhesive layer 1 of the image-receiving sheet 2 is completely transferred onto the toner receiving layer 5 of the support 4 as the assembly passes between the nip rollers 44*a* and 44*b* and the image-receiving sheet 2 having the adhesive layer 1 is separated from the final support 4 having the transferred toner image T fixed on the toner receiving layer 5. The separated image-receiving sheet 2 is wound up by the takeup roller 47 for another use.

The support 4 carrying the fixed toner image T is recovered in the tray 46 as a print having a monochromatic image formed thereon.

The foregoing discussion concerns the formation of a monochromatic image by a method in which a toner image formed by development with a liquid developer is first transferred onto the intermediate transfer element having an adhesive layer and thence retransferred onto the final support. A color image can be formed in essentially the same manner, which proceeds as follows. First, in response to one of the three or four color image signals of interest (in the case shown in FIG. 3*h*, a yellow (Y) image signal), a latent electrostatic image is formed on the photoconductor and developed to produce a toner image of the color of interest. The color toner image is then adhesive-transferred onto the image-receiving sheet serving as an intermediate transfer element and retransferred onto the toner receiving layer of the support (see FIGS. 3*a*-3*g*). As a result, a yellow image TY is formed as the bottommost layer on the support as shown in FIG. 3*h*. Subsequently, the same process is repeated for the other colors, magenta (M), cyan (C) and black (B), so that a magenta toner image TM, a cyan toner image TC and a black toner image TB are fixed in superposition on the yellow toner image TY formed on the toner receiving layer 5 of the support 4, whereby a desired color image is produced.

In the example shown in FIG. 2, the image-receiving sheet 2 having the adhesive layer 1 is wound up by the takeup roller 47 so that it can be put to another use. This is not the sole case of the present invention and the following modification may be adopted: the image-receiving sheet 2 is rewound by the supply roller 32 to a predetermined position where it can be immediately put to another use and, after the sheet is used for a predetermined number of times, say, until it is no longer usable, the sheet is wound up by the takeup roller 47.

In either example of the image forming method of the present invention described above, the residual electric charges are removed from the photoconductor 11 by means of the erasing device 25 after the adhesive transfer of toner image and, if necessary, the surface of the photoconductor 11 is cleaned by the cleaning means 26 so that it is conditioned for the next cycle of toner image formation.

The support 4 to be used in the apparatus described above is not limited to a sheet form and it may be in a continuous film or tape form.

As described on the foregoing pages, the present invention relates basically to an electrophotographic image forming method which comprises the steps of forming a toner image on the photoconductor on an electrophotographic photoreceptor drum, tack-transferring the toner image onto the adhesive layer of an intermediate transfer element and then retransferring the toner image onto a support to form the final image. The method is characterized by the following: the photoconductor on the electrophotographic photoreceptor drum is an a-Si (amorphous silicon) photoconductor having a SiC (silicon carbide) surface; the toner comprises particles coated with a polymer having a cohesive energy constant G of at least 280; and the adhesive layer of the intermediate transfer element contains a urethane (meth)acrylic resin as a main component. Because of these features, the toner image which is adhesive-transferred from the photoconductor onto the intermediate transfer element can be completely transferred onto the final support in an easy and simple manner, whereby a continuous-tone image of high quality and contrast can be reproduced with high fidelity.

Hence, the image forming method of the present invention is most suitable for use in applications where continuous-tone image of high quality and contrast are required, such as in copying medical diagnostic image, printing proofs and photographs, as well as in printing the image produced with image processing apparatus.

In addition, compared to the conventional methods that use intermediate transfer elements such as a transfer belt or roll, the method of the present invention achieves a very high transfer efficiency which is nearly 100%. Furthermore, if a cleaning means need be provided, a very simple one will do, so unlike the conventional methods, the surface of the photoreceptor or the intermediate transfer element will not be damaged by the cleaning means and a continuous-tone image of high quality and contrast can be produced.

Complete transfer of the toner image can also be achieved by a conventional signature color proofing system but in that system the photoreceptor can only be used for one cycle of image formation. In contrast, the method of the present invention permits both the photoreceptor and the adhesive layer of the intermediate transfer element to be used for a large number of cycles, so that the cost of image formation per cycle can be substantially reduced.

Prior art image forming methods such as the LANDA process require the use of special grades of toner. On the other hand, the toner to be used in the method of the present invention has such high dispersion stability that its particles will neither agglomerate nor settle in the liquid developer during storage or use and, therefore, it is easy to handle.

As described on the foregoing pages, the present invention enables a continuous-tone image of high quality and contrast to be easily formed with a extremely high fidelity of reproduction.

EXAMPLES

An example of the preparation of liquid developers to be used in the present invention is shown below.

1. Preparation of liquid developers

Liquid developers were prepared by the following procedure.

A styrene-butadiene copolymer as a coating agent (ASAFLEX 800 of Asahi Chemical Industry Co., Ltd.) and Isopar L (Esso Standard Co.) were charged into a planetary mixer (Tokushu Kika K.K.) in respective amounts of 3 and 7.5 parts by weight, and they were kneaded at 100° C. for ca. 7 h.

In the process of kneading, the coating agent was plasticized to yield a spongy flexible fluid having Isopar L incorporated into the coating polymer.

Subsequently, Carbon Black 40 (Mitsubishi kasei Corp.) was added as a pigment in an amount of 1 part by weight and further kneading was conducted at 100° C. for 2*h*. The mixture was cooled to room temperature and recovered as a black soft solid cake. Thereafter, 10 parts by weight of the cake, 31.3 parts by weight of Isopar H, 8.7 parts by weight of a 10 wt % solution of a styrene-butadiene copolymer (Solprene 1205) as a dispersant in Isopar H and 160 parts by weight of glass beads were put into a mayonnaise bottle and shook with a paint shaker (Toyo Seiki K.K.) to make a dispersion. Then, 1.43 parts by weight of the dispersion and 1 part by weight of a 1 wt % solution of basic barium petronate (Witco Corporation) as a charge control agent in Isopar G were diluted with 7.25 parts by weight of Isopar G. After agitation, the dilution was left to stand in the dark at room temperature for ca. 5 days until a stable charged state was obtained. By measurement with a nano-sizer, the average size of the toner particles in the thus prepared liquid developer was found to be 0.3–0.4 μm. When the toner particles were dropped on an interdigital electrode with an applied voltage, they were only deposited on the positive side of the electrode. It was therefore clear that the toner had a negative polarity.

For use in the present invention, various liquid developers were prepared using the coating polymers shown below. The method of their preparation was the same as described above except for the time required to plasticize the coating polymers with a planetary mixer.

2. Cohesive energy constant G of coating polymers

The following polymers were used as toner coatings in the present invention.

(1) Styrene-butadiene copolymer

-continued (ASAFLEX 800 of Asahi Chemical Industry Co., Ltd.)

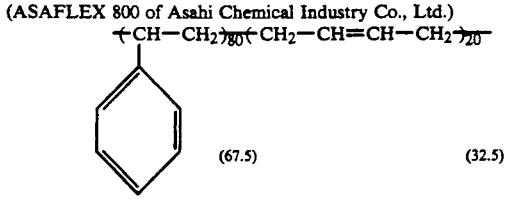

(67.5) (32.5)

(2) Styrene-butadiene copolymer (ASAPRENE 6500 of Asahi Chemical Industry Co., Ltd.)

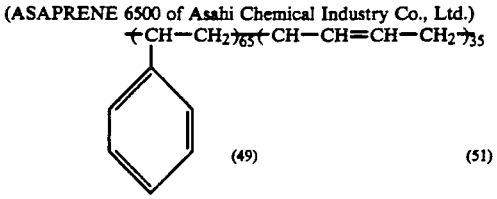

(49) (51)

(3) Methyl methacrylate-stearyl methcrylate copolymer (product of Fuji Photo Film Co., Ltd.)

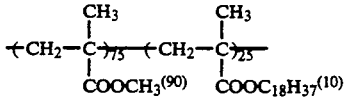

(4) Ethylene-methacrylic acid copolymer (ELVAX II 5720 of Mitsui-Dupont Co., Ltd.)

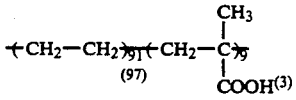

(The figures in parentheses represent mol %)

The values of the cohesive energy constant G of the respective coating polymers are computed as the sum of their constituent atomic groups using the cohesive energy constants of atoms and atomic groups listed in Table 1 below as cited from P. A. Small, J. Appl. Chem., 3, 71 (1953).

TABLE 1

Values of Cohesive Energy Constant G at 25° C.

| Substituent | G | Substituent | G |
|---|---|---|---|
| $-CH_3$ | 214 | $>C=O$ (ketones) | 275 |
| $-CH_2-$ | 133 | $-COO-$ (esters) | 310 |
| $>CH$ | 28 | $-CN$ (nitriles) | 410 |
| $>C<$ | −93 | $-Cl$ (average) | 260 |
| $=CH_2$ | 190 | $-Cl$ (one) | 270 |
| $-CH=$ | 111 | $-Cl$ (two) $> CCl_2$ | 260 |
| $-C\equiv CH$ | 285 | $-Cl$ (three)$-CCl_3$ | 250 |
| $-C\equiv C-$ | 222 | $-Br$ (one) | 340 |
| phenyl | 735 | $-I$ (one) | 425 |
| phenylene (o, m, p) | 658 | $-CF_2$ (F) | 274 |
| naphthyl | 1146 | $-S-$ (sulfide) | 225 |
| 5-membered ring | 105~115 | $-SH$ (thiols) | 315 |
| 6-membered ring | 95~105 | $-NO_2$ (nitro group) | ~440 |
| conjugate bond | 20~30 | $-PO_4$ (organic phosphoric acid) | ~500 |
| H (active hydrogen) | 80~100 | $-ONO_2$ (nitrate) | ~440 |
| $-O-$ (ethers) | 70 | | |

Example of calculation for;

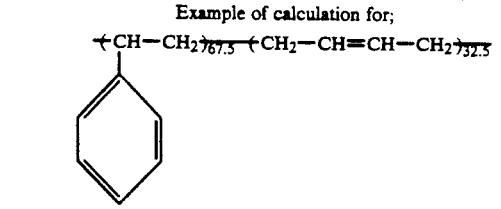

| | | |
|---|---|---|
| $\leftarrow CH-CH_2 \rightarrow_{65}$ | | 28 |
| | $-\overset{\vert}{C}H-$ | |
| | $-CH_2-$ | 133 |
| | | 735 |
| | | 896 |
| $\leftarrow CH_2-CH=CH-CH_2 \rightarrow$ | $-CH_2 \times 2$ | 266 |
| | $=CH- \times 2$ | 222 |
| | | 488 |

Therefore, the molecular cohesive energy constant for the recurring units of the polymer of interest is calculated as:

$$G = (896 \times 0.675) + (488 \times 0.325) = 763.4$$

The values of similarly calculated molecular cohesive energy constant G are listed in Table 2.

Molecular cohesive energy E (cal/mol) can be determined from the relationship $$E = \frac{\rho(G)^2}{\text{molecular weight}}$$

where $\rho$ is density (g/cm$^3$) and in this way can the cohesive energy G (cal/mol) per recurring unit of a polymer be calculated. The calculated values of the molecular cohesive energy constant and molecular cohesive energy of the coating polymers used in the present invention are listed in Table 2.

Figure 4:
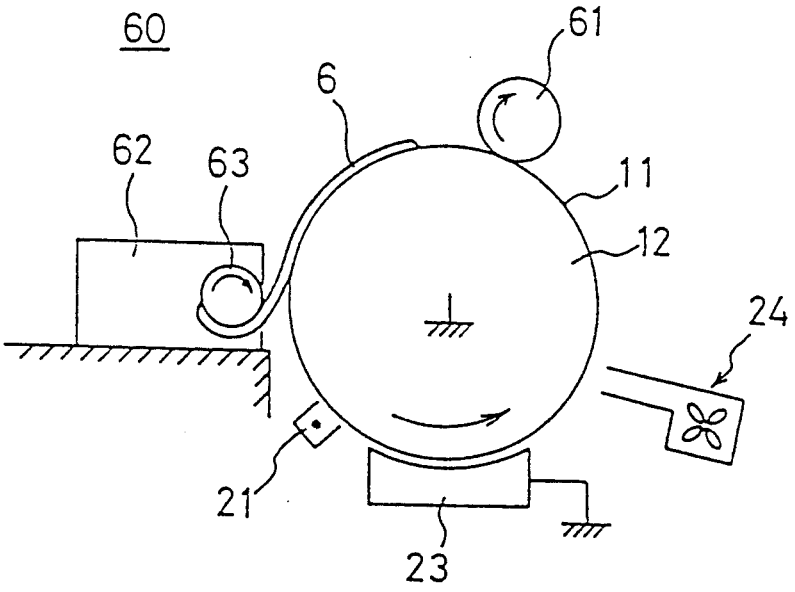
FIG. 4 is a diagrammatic cross section of the apparatus used to measure the peeling force in the experiments conducted to evaluate the performance of the image forming method of the present invention.
Figure 5:
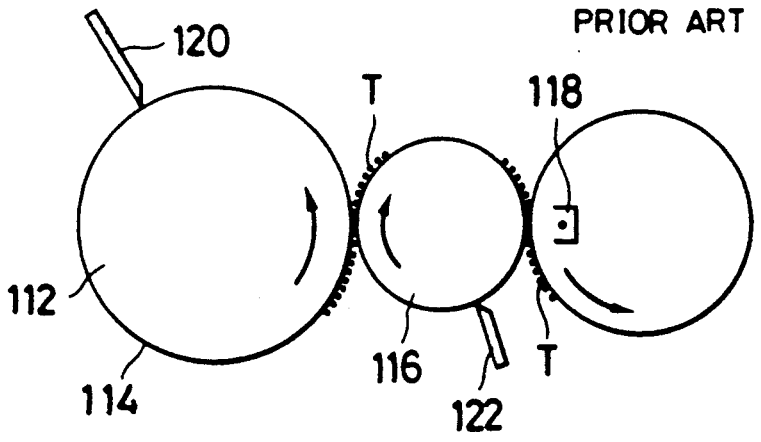
FIG. 5 is a diagram showing schematically an example of the apparatus used to implement a prior art image forming method.
Figure 6:
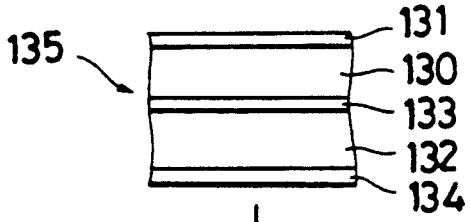
FIG. 6 (a) PRIOR ART
FIGS. 6*a*–6*d* are diagrams showing schematically a prior art image forming process.
Figure 6:
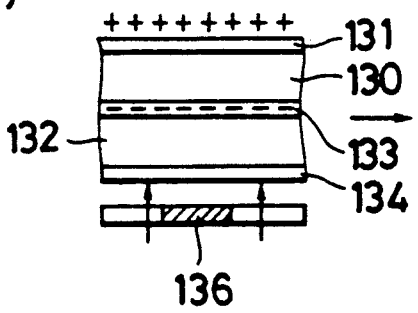
FIG. 6 (b) PRIOR ART
Figure 6:
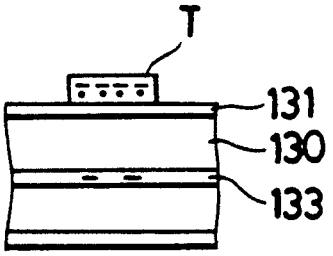
FIG. 6 (c) PRIOR ART
Figure 6:
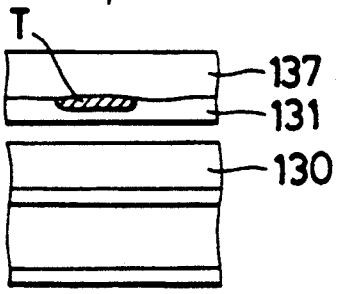
FIG. 6 (d) PRIOR ART
Figure 7A:
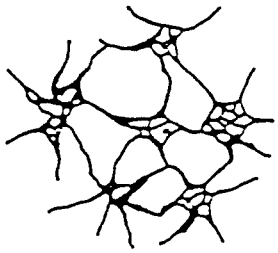
FIG.7a PRIOR ART
FIG. 7*a* is an enlarged schematic view of the toner used in a prior art electrophotographic process.
Figure 7B:
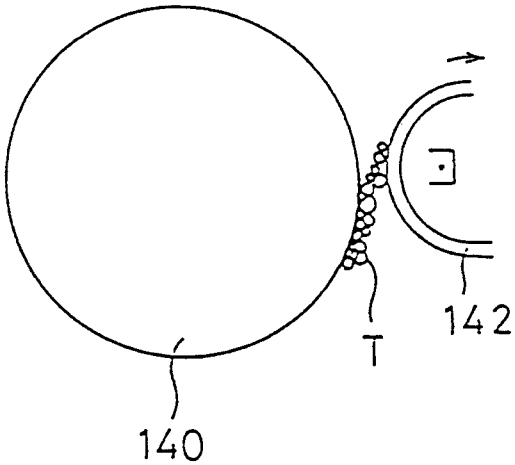
FIG.7b PRIOR ART
FIG. 7*b* is a diagrammatic view showing how the image of the toner shown in FIG. 7*a* is transferred onto a receiving element.

A peeling force measuring instrument of the type shown in FIG. 4 was constructed and used to measure the force required for a toner image T on a photoconductor 11 on a photoreceptor drum 12 to be peeled from an adhesive film 6. The photoconductor 11 was an a-Si photoconductor having a SiC surface.

3. Measurement of peeling force

Using the peeling force measuring instrument 60, a peeling force measurement was conducted in the following manner.

The photoreceptor drum 12 was electrified to a desired charge potential with a corona charging device 21. The resulting latent electrostatic image was developed with a liquid developing unit 23 and subsequently dried with a drum drying means 24. As a result, a dried toner image (solid image) T was formed on the photoconductor 11 on the photoreceptor drum 12. The adhesive film 6 having a width of 25 mm was attached to the toner image T by means of a rubber roller 61 at a constant pressure and speed. The pressure imparted by the rubber roller 61 was 5 kg/30 cm and the speed of film attachment was 5.5 mm/sec. When the film attachment ended, the photoreceptor drum 12 was adjusted to be freely rotatable and the front end of the adhesive film 6 was peeled and wound onto a torque detecting 40$\phi$ roller 63 on a peeling checker 62 (Kanzaki Paper Mfg. Co., Ltd.) in preparation for peeling force measurement. Thereafter, the torque detecting roller 63 on the peeling checker 62 was rotated at a peripheral speed (V) of 0.9 mm/sec in the direction indicated by an arrow in FIG. 4, whereupon the adhesive film 6 separating from the freely rotating photoreceptor drum 12 was taken up by the torque detecting roller 63, with the required peeling force being measured with the peeling checker 62.

The thus measured value of peeling force contained a force component that corresponded to the torque required for rotating the photoreceptor drum 12 as the follower of the torque detecting roller 63. To determine the true peeling force, this force component was subtracted from the measured value of peeling force.

The force component corresponding to the torque due to the rotation of the photoreceptor drum 12 as the follower of the torque detecting roller 63 was measured in the following manner: a non-adhesive film 25 mm wide was wound onto the photoreceptor drum 12, with the front end of the film being fixed to the torque detecting roller 63 on the peeling checker 62 and with its rear end being fixed to the photoreceptor drum 12; with the film set in this way, the torque detecting roller 63 was rotated while the photoreceptor drum 12 rotating as the follower.

Peeling force measurements were conducted using the aforementioned coating polymers. The principal results are shown in Table 2. In consideration of the fact that peeling force is generally variable with the amount of toner deposition, the charge potential was varied to adjust the amount of toner deposit and the values of peeling force for a transmission density of 1.0 when complete transfer was achieved are listed in Table 2.

TABLE 2

| Run No. | Coating polymer | Specific gravity $\rho$ g/cm$^3$ | Molecular weight | cohesive energy constant G | Molecular cohesive energy E cal/mol | Peeling force g/25 mm |
|---|---|---|---|---|---|---|
| 1 | ASAFLEX 800 (Asahi Chemical Industry Co., Ltd.) | 0.94~0.95 | 87.8 | 763.4 | $6.27 \times 10^3$ | 10 |
| 2 | ASAPRENE 6500 (Asahi Chemical Industry Co., Ltd.) | 0.94~0.95 | 78.5 | 687.9 | $5.70 \times 10^3$ | 130 |
| 3 | MMA-SMA copolymer (Fuji Photo Film Co., Ltd.) | 1.1 | 120.6 | 1004 | $9.19 \times 10^3$ | 30 |

TABLE 2-continued

| Run No. | Coating polymer | Specific gravity $\rho$ g/cm$^3$ | Molecular weight | cohesive energy constant G | Molecular cohesive energy E cal/mol | Peeling force g/25 mm |
|---|---|---|---|---|---|---|
| 4 | ELVAX II 5720 (Mitsui-Dupont Co., Ltd.) | 0.94 | 29.7 | 280.1 | $2.48 \times 10^3$ | 70 |

As is clear from the data shown in Table 2, the toner samples to be used in the present invention were coated with polymers having a molecular cohesive energy constant G of at least 280 as calculated from the cohesive energy constant G described by P. A. Small. Therefore, the toner particles could be peeled off by a force of no more than 130 g per width of 25 mm, permitting complete transfer of the toner image. The toner image formed of those samples could be completely transferred even when the toners were deposited on the photoreceptor drum in large amounts (exceeding 4.0 in terms of the transmission density of completely transferred toner image). Hence, in Run Nos. 1–4, the toner images on the photoreceptor drum could be transferred onto the adhesive layer of the intermediate transfer element almost completely in density regions ranging from low to high densities.

Twelve samples of image-receiving sheet 2 were prepared as the intermediate transfer element of the present invention by coating adhesive compositions (for their formulas, see the following Experimental Run Nos. 1–11) on a polyethylene terephthalate film base 2*a* (26 μm thick by 25 mm wide) to provide a thickness of 10 μm after heating and by then drying the coating at 80° C. for 5 min.

Using the toner of Run No. 1 shown in Table 2 and those samples of image-receiving sheet 2, experiments were conducted with the electrophotographic system of FIG. 2 equipped with an a-Si photoconductor having a SiC surface. In each experiment, the toner image on the photoconductor was transferred onto the adhesive layer 1 of the image-receiving sheet 2 and retransferred onto the final support by thermocompression, with the image-receiving sheet 2 being then stripped from the final support 4. The transferability of toner from the photoconductor 11 to the image-receivig sheet 2 and that of toner from the image-receiving sheet to the final support were evaluated by visually checking the uniformity of the residual toner image on the surface of the photoconductor 11, the residual toner image on the adhesive layer of the image-receiving sheet 2 and the toner image on the final support.

Criteria for visual evaluation (1) Toner image on the final support
○ . . . no unevenness
Δ . . . very small degree of unevenness
X . . . unevenness was observed
(2) Photoconductor's surface and adhesive layer
○ . . . no residual toner was observed
Δ . . . very small amount of residual toner was observed
X . . . residual toner was observed Measurements were also conducted for the initial adhesion of the adhesive layer of each image-receiving sheet 2 and the adhesion of the same after transfer.

The results of the visual evaluation and those of adhesion measurements are shown in Table 3.

| | |
|---|---|
| Experiment 1 | |
| Acrylic rubber (TOA ACRON PS-210 of Toa Paint Co., Ltd.) | 25 parts |
| GOSERAC UV-4200 B (Nippon Synthetic Chemical Industry Co., Ltd.) | 75 parts |
| COLONATE 2030 (Nippon Polyurethane Industry Co., Ltd.) | 1 part |
| Benzoyl peroxide | 0.5 part |
| Toluene | 140 parts |
| Experiment 2 | |
| TOA ACRON XF-3388 (Toa Paint Co., Ltd.) | 30 parts |
| Urethane acrylic resin (ALONIX M-1200 of Toagosei Chemical Industry Co., Ltd.) | 70 parts |
| YS POLYSTER T-115 (Yasuhara Yushi Kogyo K.K.) | 5 parts |
| COLONATE L (Nippon Polyurethane Industry Co., Ltd.) | 3 parts |
| DALOCURE 1116 (Merck & Co., Inc.) | 3 parts |
| Toluene | 140 parts |
| Experiment 3 | |
| TOA ACRON XF-3388 (Toa Paint Co., Ltd.) | 30 parts |
| Urethane acrylic resin (ALONIX M0-1200 of Toagosei Chemical Industry Co., Ltd.) | 70 parts |
| YS POLYSTER T-115 (Yasuhara Yushi Kogyo K.K.) | 5 parts |
| COLONATEL (Nippon Polyurethane Industry Co., Ltd.) | 3 parts |
| Lauroyl peroxide (Nippon Oil & Fats Co., Ltd.) | 0.5 part |
| Toluene | 140 parts |
| Experiment 4 | |
| TOA ACRON XF-3388 (Toa Paint Co., Ltd.) | 30 parts |
| Urethane acrylic resin (ALONIX M-1200 of Toagosei Chemical Industry Co., Ltd.) | 70 parts |
| YS POLYSTER T-115 (Yasuhara Yushi Kogyo K.K.) | 5 parts |
| COLONATE L (Nippon Polyurethane Industry Co., Ltd.) | 3 parts |
| DALOCURE 1116 (Merck & Co., Inc.) | 5 parts |
| Fluorine-containing surfactant (MEGAFAC F-183 of Dainippon Ink & Chemicals, Inc.) | 2 parts |
| Experiment 5 | |
| TOA ACRON XF-3388 (Toa Paint Co., Ltd.) | 30 parts |
| Urethane acrylic resin (ALONIX M-1200 of Toagosei Chemical Industry Co., Ltd.) | 70 parts |
| YS POLYSTER T-115 (Yasuhara Yushi Kogyo K.K.) | 5 parts |
| COLONATEL (Nippon Polyurethane Industry Co., Ltd.) | 3 parts |
| Benzoyl peroxide | 0.7 part |
| Fluorine-containing surfactant (MEGAFAC F-183 of Dainippon Ink & Chemicals, Inc.) | 2 parts |
| Experiment 6 | |
| Acrylic rubber (NOXTITE 7885 - NL of Nippon Mectron Co., Ltd.) | 15 parts |
| Urethane acrylic resin (UA-3061 of Kyoeisha Oil & Grease Chemical Industry Co., Ltd.) | 80 parts |
| Epoxy resin (EPON 1007 of Shell Chemical Co.) | 5 parts |
| Photoreaction initiator (IRGACURE 651 of Ciba-Geigy Corporation) | 5 parts |
| Toluene | 140 parts |
| Trifluoroethylene polymer | 5 parts |
| Isopropyl alcohol | 8 parts |
| Experiment 7 | |
| Acrylic rubber (NOXTITE 7885 - NL of Nippon Mectron Co., Ltd.) | 15 parts |
| Urethane acrylic resin (UA-3061 of Kyoeisha Oil & Grease Chemical Industry Co., Ltd.) | 80 parts |
| Epoxy resin (EPON 1007 of Shell Chemical Co.) | 5 parts |
| Benzoyl peroxide | 0.5 parts |
| Toluene | 140 parts |

-continued

| | |
|---|---|
| Trifluoroethylene polymer | 5 parts |
| Isopropyl alcohol | 8 parts |
| Experiment 8 | |
| Saturated polyester resin (LP-0011 of Nippon Synthetic Chemical Industry Co., Ltd.) | 40 parts |
| Urethane acrylic resin (UV-3000B of Nippon Synthetic Chemical Industry Co., Ltd.) | 60 parts |
| IRGACURE 184 (Ciba-Geigy corporation) | 5 parts |
| Toluene | 140 parts |
| Fluorine-containing surfactant (SURFLON S-145 of Asahi Glass Co., Ltd.)) | 3 parts |
| Experiment 9 | |
| Saturated polyester resin (LP-0011 of Nippon Synthetic Chemical Industry Co., Ltd.) | 40 parts |
| Urethane acrylic resin (UV-3000B of Nippon Synthetic Chemical Industry Co., Ltd.) | 60 parts |
| Benzoyl peroxide | 0.5 part |
| Toluene | 140 parts |
| Fluorine-containing surfactant (SURFLON S-145 of Asahi Glass Co., Ltd.) | 3 parts |
| Experiment 10 | |
| Saturated polyester resin (VYLON 300 of Toyobo Co., Ltd.) | 20 parts |
| Urethane acrylic resin (GOSERAC UV-7000 B of Nippon Synthetic Chemical Industry Co., Ltd.) | 80 parts |
| Photoreaction initiator (IRGACURE 651 of Ciba-Geigy Corporation) | 3 parts |
| Filler (AEROSIL R-972 of Nippon Aerosil Co., Ltd.) | 1 part |
| Toluene | 140 parts |
| Fluorine-containing additive (MODAFLOW F 100 of Nippon Oil & Fats Co., Ltd.) | 3 parts |
| Experiment 11 | |
| Saturated polyester resin (VYLON 300 of Toyobo Co., Ltd.) | 20 parts |
| Urethane acrylic resin (GOSERAC UV-7000 B of Nippon Synthetic Chemical Industry Co., Ltd.) | 80 parts |
| Benzoyl peroxide | 0.5 part |
| Filler (AEROSIL R-972 of Nippon Aerosil Co., Ltd.) | 1 part |
| Toluene | 140 parts |
| Fluorine-containing additive (MODAFLOW F 100 of Nippon Oil & Fats Co., Ltd.) | 3 parts |
| Comparative Sample | |
| 2-Ethylhexyl acrylate | 98 parts |
| Acrylic acid | 2 parts |
| Ethyl acetate | 100 parts |
| Toluene | 200 parts |
| Benzoyl peroxide | 1 part |

TABLE 3

| | Adhesion (g/25 mm) | | Visual evaluation | | |
|---|---|---|---|---|---|
| Run No. | initial transfer | after transfer | final support | Photo-conductor | adhesive layer |
| 1 | 560 | 530 | ○ | ○ | ○ |
| 2 | 220 | 200 | ○ | ○ | ○ |
| 3 | 220 | 190 | ○ | ○ | ○ |
| 4 | 70 | 65 | ○ | ○ | ○ |
| 5 | 70 | 60 | ○ | ○ | ○ |
| 6 | 125 | 100 | ○ | ○ | ○ |
| 7 | 125 | 105 | ○ | ○ | ○ |
| 8 | 350 | 320 | ○ | ○ | ○ |
| 9 | 350 | 315 | ○ | ○ | ○ |
| 10 | 400 | 385 | ○ | ○ | ○ |
| 11 | 400 | 375 | ○ | ○ | ○ |
| Comparative Sample | 700 | 685 | x | ○ | x |

As is clear from the data shown in Table 3, the use of the adhesive layer of the present invention as an intermediate transfer element insures that the toner image on an a-Si photoconductor having a SiC surface is completely transferred onto the final support. Therefore, the toner image formed on the final support by the method of the present invention has high contrast and quality in the absence of uneven densities and other defects.

What is claimed is:

1. In an electrophotographic image forming method which comprises the steps of forming a toner image on the photoconductor on an electrophotographic photoreceptor drum by electrophotography, adhesive-transferring said toner image onto the adhesive layer of an intermediate transfer element and then retransferring said toner image onto a final support to form a final image, the improvement wherein the photoconductor on said electrophotographic photoreceptor drum is an a-Si (amorphous silicon) photoconductor having a SiC (silicon carbide) surface, the particles of said toner being coated with a polymer having a cohesive energy constant G of at least 280, and the adhesive layer of said intermediate transfer element being formed from an adhesive that is based on a urethane (meth)acrylic resin and which further contains at least one member selected from among an acrylic rubber, a saturated polyester resin and a fluorine-containing additive.

2. An image forming method according to claim 1 wherein the peeling force required to peel the deposited toner particles from said photoconductor together with said adhesive layer is no more than 130 g per width of 25 mm.

3. An image forming method according to claim 1 wherein the force required to peel the deposited toner particles from said photoconductor together with said adhesive layer is no more than 70 g per width of 25 mm.

4. An image forming method according to claim 1 wherein the force required to peel the deposited toner particles from said photoconductor together with said adhesive layer is no more than 30 g per width of 25 mm.

5. An image forming method according to claim 1 wherein said urethane (meth)acrylic resin is formed of at least one member selected from the group consisting of a urethane acrylic monomer, a urethane acrylic oligomer, a urethane methacrylic monomer and a urethane methacrylic oligomer.

6. An image forming method according to claim 1 wherein said adhesive layer contains a reaction initiator.

7. An image forming method according to claim 6 wherein said reaction initiator is a thermal reaction initiator.

8. An image forming method according to claim 1 wherein said intermediate transfer element and said final support are thermocompressed to each other.

9. An image forming method according to claim 1 wherein said final support is compatible with said toner coating polymer.

10. An image forming method according to claim 1 wherein said coating polymer is at least one member selected from the group consisting of a styrene-butadiene copolymer, a methyl methacrylate-stearyl methacrylate copolymer and an ethylene-methacrylic acid copolymer.

11. An image forming method according to claim 1 wherein said toner coating polymer has a cohesive energy constant G of at least 500.

12. An image forming method according to claim 1 wherein said toner coating polymer has a cohesive energy constant G of at least 700.

13. An image forming method according to claim 1 wherein the adhesive force between the surface of the photoconductor and the toner image formed thereon ($F_{P-T}$) is less than the adhesive force at the interface between the adhesive layer and the toner particles ($F_{T-A}$) and $F_{T-A}$ is less than the cohesive force between individual toner particles ($F_{T-T}$).

* * * * *